US006009577A

United States Patent [19]

Day

[11] Patent Number: 6,009,577

[45] Date of Patent: Jan. 4, 2000

[54] TRANSFORMABLE TRAVEL PILLOW

[76] Inventor: Judy A. Day, 343 Soquel Ave., Santa Cruz, Calif.

[21] Appl. No.: 09/092,628

[22] Filed: Jun. 5, 1998

[51] Int. Cl.[7] ..... A47C 20/02

[52] U.S. Cl. ..... 5/636; 5/638; 5/640; 5/951

[58] Field of Search ..... 5/636, 638, 640, 5/911, 951

[56] References Cited

U.S. PATENT DOCUMENTS

| | | | |
|---|---|---|---|
| 2,682,673 | 7/1954 | Myers | 5/490 |
| 4,139,920 | 2/1979 | Evans | 5/911 |
| 4,689,844 | 9/1987 | Alivizatos | 5/911 |
| 4,738,488 | 4/1988 | Camelio | 5/636 |
| 5,027,457 | 7/1991 | Sweet | 5/640 |
| 5,103,516 | 4/1992 | Stevens | 5/640 |
| 5,271,114 | 12/1993 | Kjersem | 5/640 |
| 5,363,524 | 11/1994 | Lang | 5/640 |
| 5,375,278 | 12/1994 | VanWinkle et al. | 5/644 |
| 5,522,105 | 6/1996 | Fujiwara et al. | 5/644 |
| 5,535,467 | 7/1996 | Ciske | 5/636 |
| 5,567,015 | 10/1996 | Arias | 297/397 |
| 5,584,086 | 12/1996 | Van Winkel | 5/644 |
| 5,630,651 | 5/1997 | Fishbane | 297/397 |
| 5,644,807 | 7/1997 | Battistella | 5/419 |
| 5,644,809 | 7/1997 | Olson | 5/636 |

*Primary Examiner*—Michael F. Trettel
*Assistant Examiner*—Fredrick Conley
*Attorney, Agent, or Firm*—Janis Biksa

[57] ABSTRACT

A transformable travel (neck) pillow is disclosed having two configurations: one, where the granular fill contents of the pillow are positioned in a collar end of a pillowcase to form a horseshoe-shaped type of pillow enclosure similar to neck pillows known at this time. Alternately, a flap of the pillowcase may be released and fill material allowed to move to a plain end of the pillow so that two tubular end sections which formerly formed the collars of the neck pillow are now empty and can be folded over the side of the pillowcase to form a rectangular-type pillow. It is expected that such a pillow would be used with organic granular-type fill materials, such as buckwheat husks (hulls).

20 Claims, 6 Drawing Sheets

TRANSFORMABLE TRAVEL PILLOW

FIELD OF THE INVENTION

This invention relates to pillows for the neck and upper spine, used for traveling and sleeping.

BACKGROUND OF THE INVENTION

Travelers who are forced to sit for a long time in an upright posture have long struggled with obtaining adequate neck support so that back or neck problems do not appear or become worse as a result of their having to sit for a long time in planes, cars, or trains. As a result of this problem, a neck pillow 20 as shown in FIG. 2, has been developed. It is a horseshoe-shaped collar which, quite often, is an inflatable structure and, more recently, has been filled with foam, feathers, or organic granular or bark-type materials. A side and top view of the conventional neck pillow is shown in FIGS. 3 and 4. FIG. 1 shows the use of a neck pillow by the traveler sitting in an upright seat. The pillow, ideally, fits around the neck and sits on the shoulders and supports the back of the neck to prevent the head from tilting sharply to one side, so that any hinging of the neck (such as might occur when a person nods off to sleep) is minimized. However, unless an inflatable pillow (which is generally considered by most travelers to be not very useful) is used, once the traveling time is over, a horseshoe-shaped travel pillow becomes a weight to be carried around and stored until the next usage.

The use of such a pillow for sleeping on a horizontal surface, for example, as shown in FIG. 5, is contrary to popular experience where a plain, rectangular-type pillow 22, a perspective view of which is shown in FIG. 6 (a side view of which is shown in FIG. 7) supports the head of a sleeping person 24 as shown in FIG. 5. The conventional-type pillow 22, as shown in FIG. 6, has all the disadvantages of a standard airline-type pillow, namely, that it does not remain propped on one's shoulders but slides down one's back every time one leans forward. It is not an acceptable alternative for the most demanding travelers.

Travelers are therefore faced with the issue of whether they want to take along a pillow which is good for their neck and back and then have to carry it around and store it within their luggage until the next seated usage. Travelers are interested in having a pillow which they may use both for traveling and also in other instances. For example, travelers are searching for pillows which may be used in a normal horizontal sleep configuration that provides them better neck support and a more consistent night's rest lying horizontally, and which also maintains the advantages of a travel-type neck pillow when they are traveling.

SUMMARY OF THE INVENTION

The present invention provides a transformable travel pillow which utilizes granular or flowable material within a pillowcase which is configured to be folded in one of two configurations so that, in one configuration, the pillow fill is relatively firm and is contained within a collar end of a pillowcase opposite a plain end of a pillowcase. The pillowcase at the collar end includes two tubular collar sections extending approximately in the same direction with a saddle section, sized to receive the neck of a person, between the two tubular collar sections. This configuration of the invention is like the horseshoe shape of the neck pillow previously described. The relationship of the flowable or granular fill material within the pillowcase is such that when it is positioned to substantially fill the collar end of the pillowcase, the two tubular collar sections of the pillowcase in the middle portion of the pillowcase (including the saddle section) are substantially full of fill material (either granular or flowable) while fill material is substantially absent from the plain end of the pillowcase. The empty plain end of the pillowcase forms a plain end flap which can be folded over the side of the pillowcase to capture and hold the fill material in the collar end of the pillowcase.

Alternately, when the fill material is positioned to substantially fill the plain end of the pillowcase, the plain end of the pillowcase and the middle portion of the pillowcase are substantially full of fill material, while fill material is substantially absent from the two tubular collar sections at the collar end of the pillowcase. In such a configuration, the two tubular collar sections of the pillowcase can be folded over a side of the pillowcase to capture and hold the granular fill material in a relatively compact density in the plain end of the pillowcase.

When either the plain end or the collar end of the pillowcase is folded over onto the side of the pillowcase, it can be fastened to the side of the pillowcase by a fastener system which can be buttons and buttonholes, velco-type hook and loop array system, or a projections-projection receiving snaps which maintain the configuration of the pillow in either a neck collar-type arrangement or a plain approximately rectangular arrangement. The use of the fastening system may be designed so that one half of a fastening system is positioned only at one point on the pillowcase while, depending on where the fill material is located, that half of the fastening system may be mated with one of two locations at which second halves of the fastening system are located to fold the pillowcase accordingly towards the collar end or towards the plain end, as appropriate.

The fill material is, preferably, granular-type buckwheat hulls, but may be any of the flowable, minimally compressible pillow-fill materials known to a person of ordinary skill in the art.

BRIEF DESCRIPTION OF THE DRAWINGS

FIG. 8 is a perspective view of a vertically-oriented pillowcase;

FIG. 9 is a cross sectional view of FIG. 8 and its orientation taken at 9—9 of FIG. 8;

FIG. 10 is a cross sectional view of the pillowcase of FIG. 9 having been placed in a horizontal position with its plain-end flat folding towards its attachment point;

FIG. 11 shows the completed attachment of the plain end flap on the side of the pillowcase of a pillow configuration, for example, as shown in FIG. 12, a cross section of which is taken at 11—11 ;

DETAILED DESCRIPTION

Figure 1:
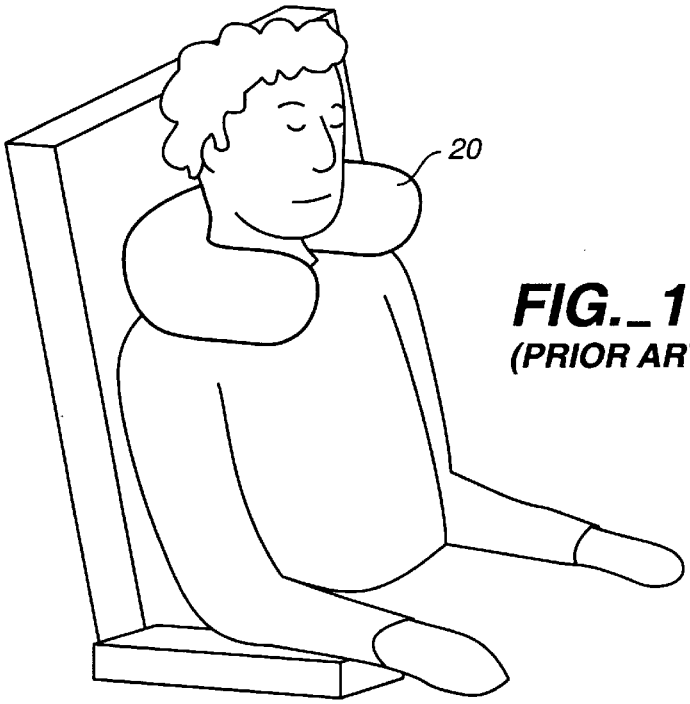
FIG. 1 (PRIOR ART)
FIG. 1 is perspective view of a traveler using a prior art travel neck pillow.
Figure 2:
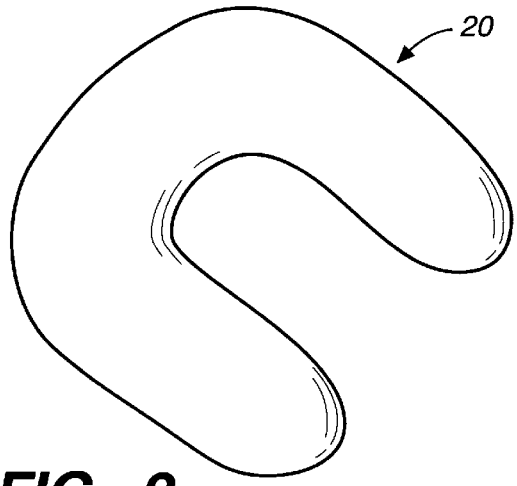
FIG. 2 (PRIOR ART)
FIG. 2 is a perspective view of the prior art travel neck pillow of FIG. 1.
Figure 3:
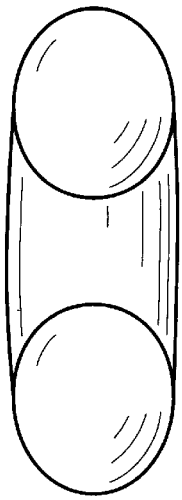
FIG. 3 (PRIOR ART)
FIG. 3 is an end view of the neck pillow of FIG. 2.
Figure 4:
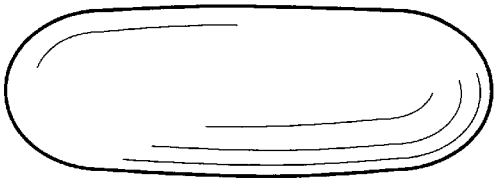
FIG. 4 (PRIOR ART)
FIG. 4 is a side view of the neck pillow of FIG. 2.
Figure 5:
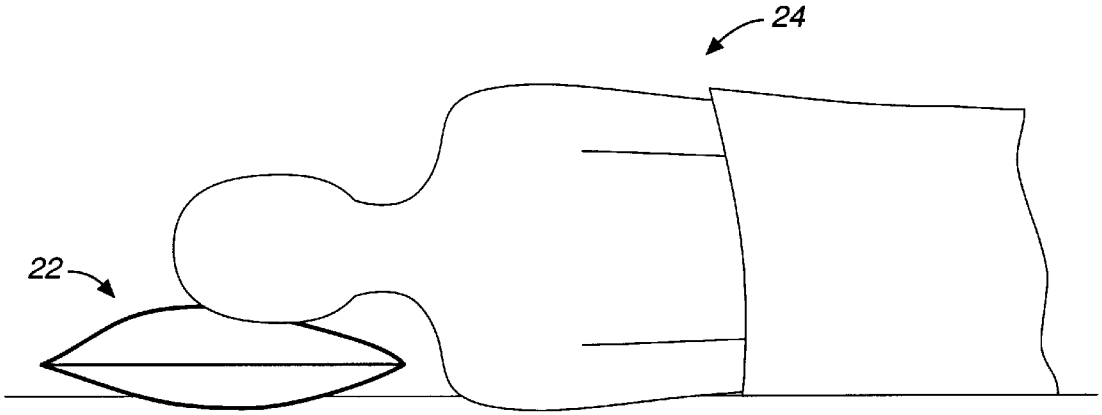
FIG. 5 (PRIOR ART)
FIG. 5 is an elevational view of a person sleeping on a conventional pillow.
Figure 6:
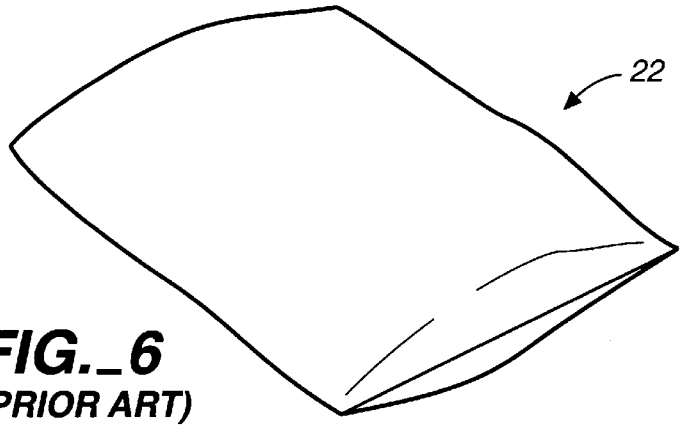
FIG. 6 (PRIOR ART)
FIG. 6 is a perspective view of a conventional pillow, as shown in FIG. 5.
Figure 7:
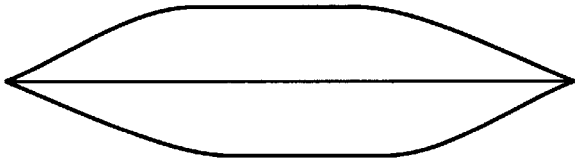
FIG. 7 (PRIOR ART)
FIG. 7 is an elevational view of the pillow of FIG. 5.
Figure 8:
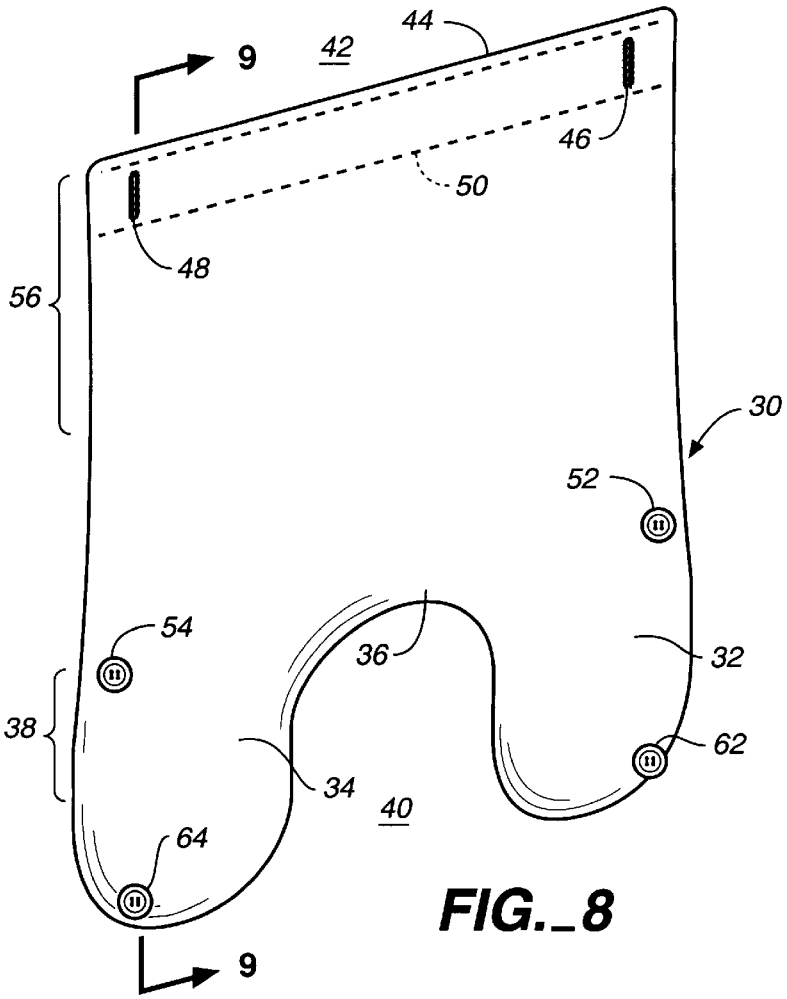
FIGS. 8, 9, 10 and 11 show a progression of steps of positioning the pillow fill at a collar end of the pillowcase to fold the plain end flap over and attach it to the side of the pillowcase to achieve a configuration as shown in FIGS. 11 and 12.
Figure 9:
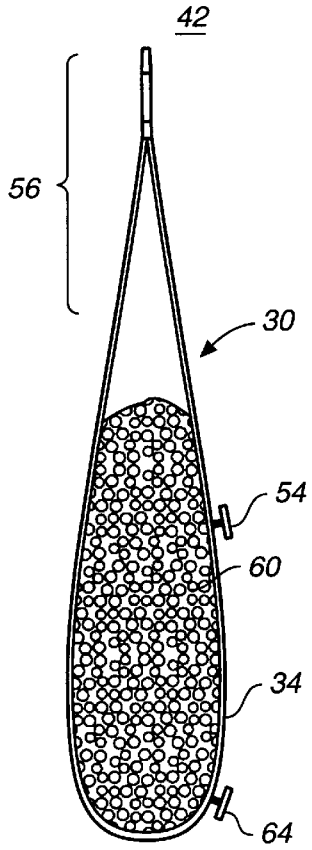

A configuration according to the invention can be best understood by viewing a whole side of a pillowcase 30 as seen in FIG. 8. The pillowcase 30 has two tubular collar sections 32, 34 with a saddle section 36 between the collar sections. A middle portion 38 of the pillowcase is located between the collar end 40 and plain end 42 of the pillowcase. As depicted in FIG. 8, the plain end includes a closed sewn end section 44 having buttonholes 46, 48 therethrough (alternately a set of two or more snaps can be used). The dashed line 50 depicts the approximate location of a zipper for accessing the fill within the pillowcase 30. (The pillowcase may contain an inner case which is separately sealed to contain the fill. Fill material may be added or removed to accommodate a user's preference.) The granular fill material can be buckwheat hulls, such as are well-known in the art A pair of centrally located buttons 52, 54 are aligned with one another and aligned with the buttonholes 46, 48 (or alternately snaps can be substituted for the button-buttonhole connection) when the plain end of flap 56 is folded towards the middle portion 38 of the pillowcase to close the granular fill material 60 as shown in FIG. 9 within the collar end of the pillowcase. A second set of collar end buttons 62, 64 are aligned with each other and the buttonholes 46, 48 such that when a normal rectangular pillow configuration is to be used and the fill material is positioned appropriately, the button holes or other fastening systems, such as velcro or snaps or similar systems, will mate with the corresponding other half of the fastener system; i.e., button holes 46, 48, to maintain the pillow in the normal rectangular pillow configuration.

Figure 10:
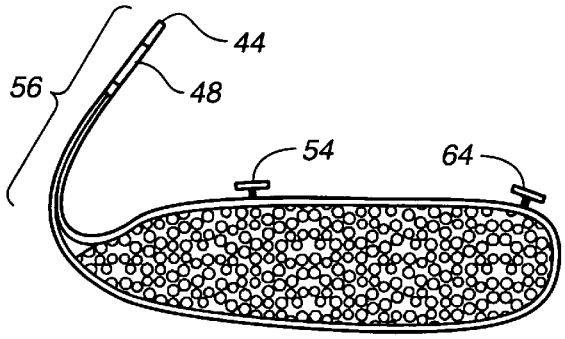
Figure 11:
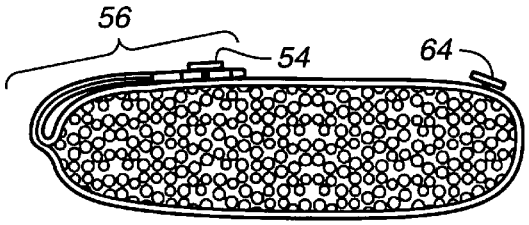

A cross section of FIG. 8 is shown in FIG. 9. The fill material 60 only partially fills the pillowcase 30 such that the collar end of the pillowcase is filled. The upper plain end of the pillowcase is substantially empty of fill material. Thus, when the plain end flap 56 of the pillowcase is folded towards the middle portion 38 so that the closed sewn end section 44 approaches the center line of buttons 52, 54, the granular fill material 60 is captured in the collar end of the pillowcase. A progression of folding is shown in FIGS. 10 and 11.

Figure 12:
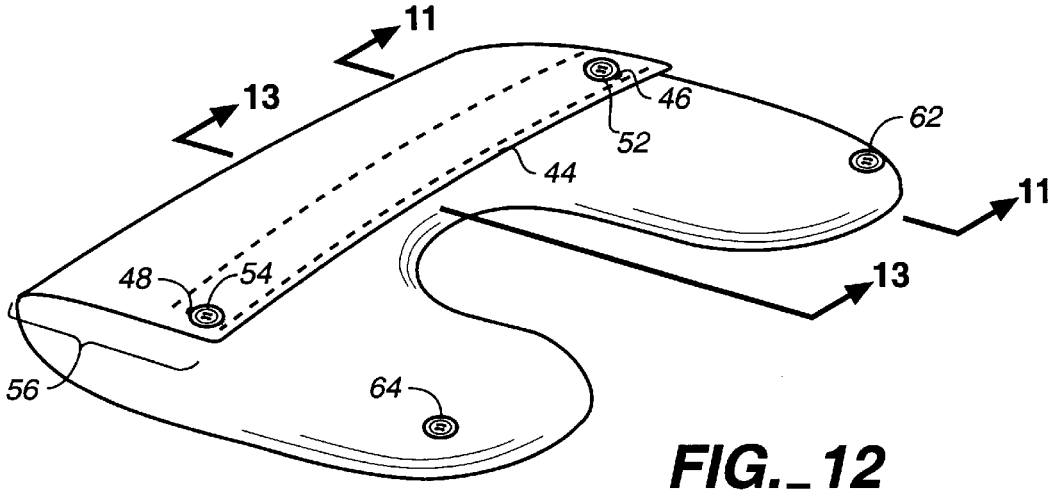
FIG. 12 is a perspective view of a transformable travel pillow according to the invention where the fill has been positioned in the collar end and the plain end flap has been folded over and fastened to a side of the pillow.

FIG. 12 shows a perspective view of a configuration according to the invention where the fill material is positioned at the collar end and the flap is closed and fastened with a fastener system to the side of the pillowcase.

Figure 13:
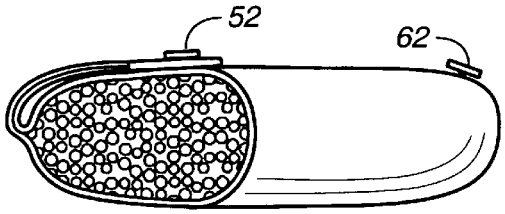
FIG. 13 is a cross sectional view of FIG. 12 taken at 13—13.

FIG. 13 shows a cross sectional view taken at 13—13 of FIG. 12 showing the fill material at the collar end of the pillowcase.

Figure 14:
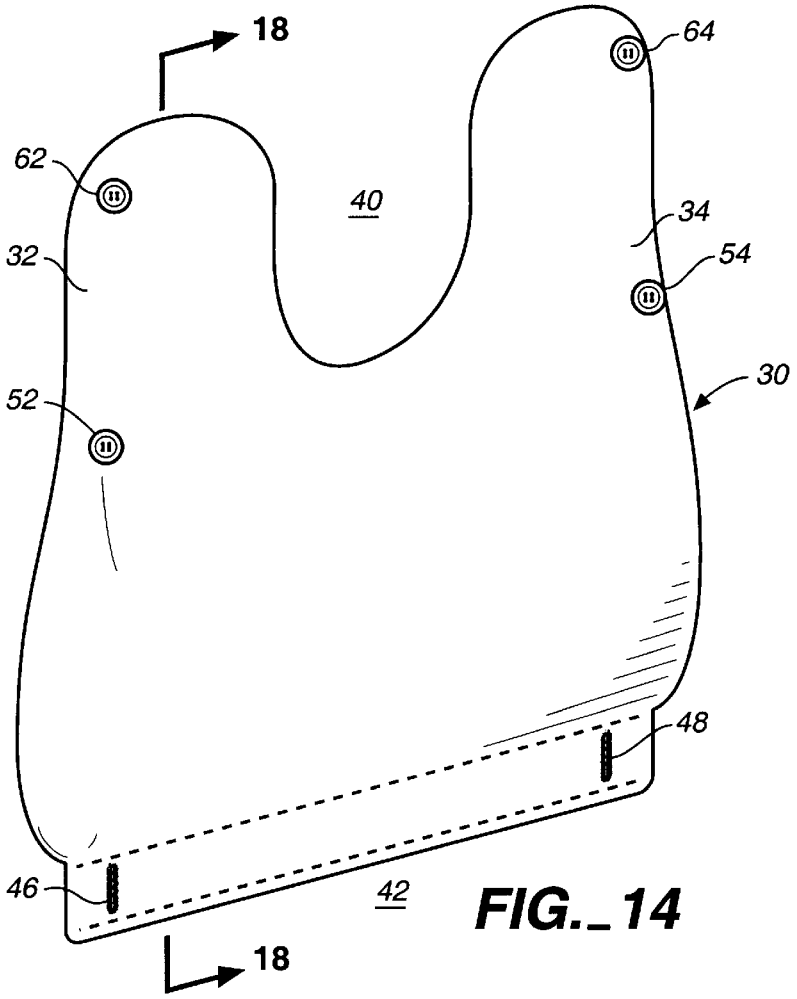
FIG. 14 is a perspective view of a pillowcase according to the invention with the two tubular collar sections raised so that the pillow fill material fills the plain end.
Figure 15:
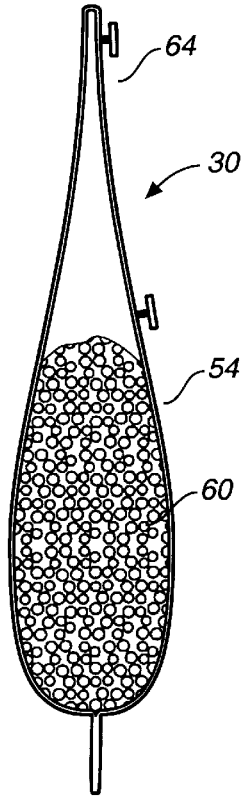
FIG. 15 is a cross sectional view of the fill materials filling the plain end of the pillowcase.
Figure 16:
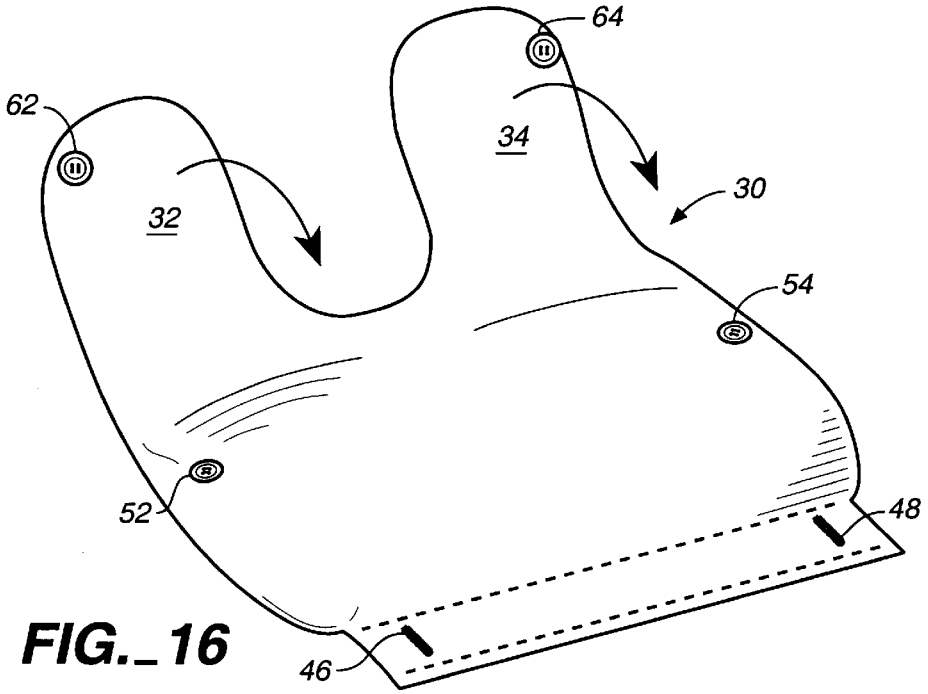
FIG. 16 shows the perspective view showing the pillowcase having been placed in the horizontal position, the two tubular collar sections being folded towards the plain end.
Figure 17:
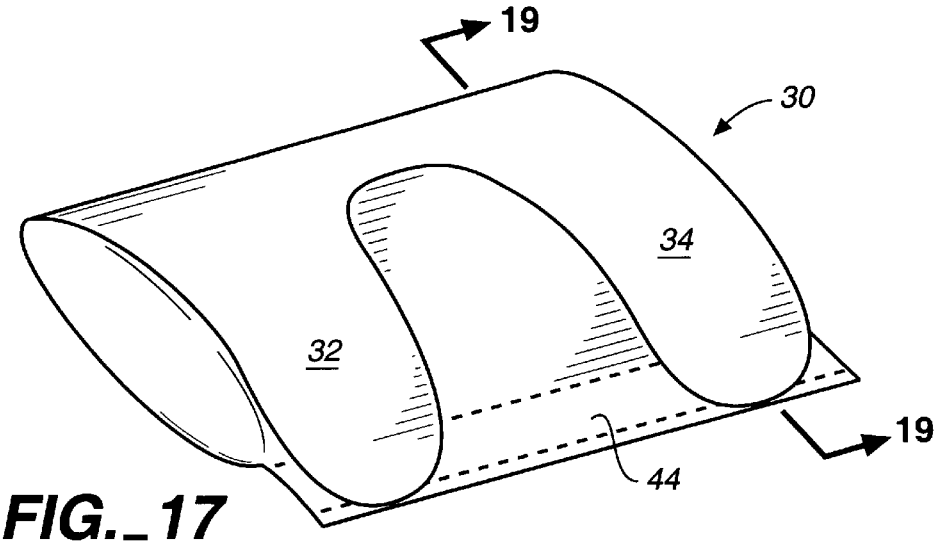
FIG. 17 is a perspective view of a transformable travel pillow according to the invention showing the pillow fill material filling the plain end with the two tubular collar sections having been folded over and fastened to the side of the pillow at the plain end of the pillow.
Figure 18:
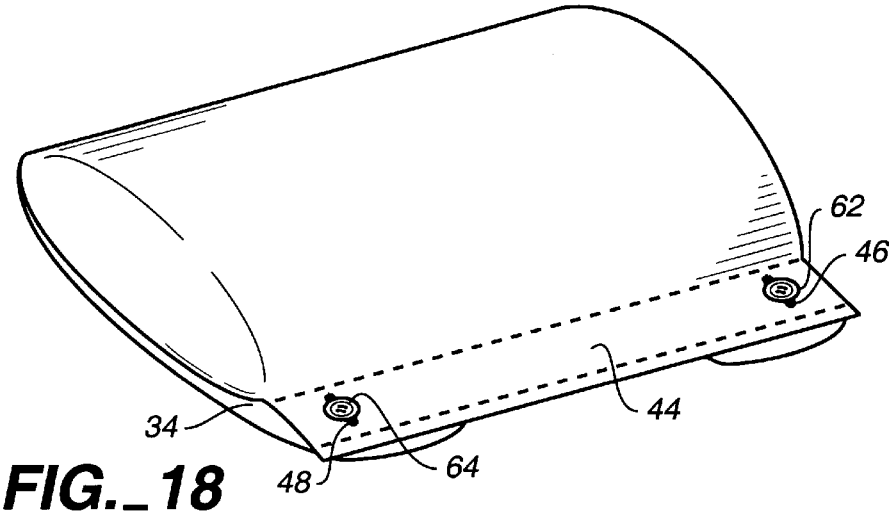
FIG. 18 shows a perspective view of the opposite side of the pillow as shown in FIG. 17.
Figure 19:
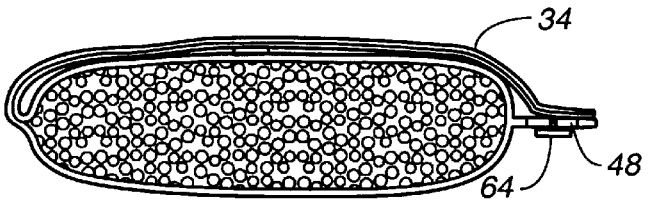
FIG. 19 shows a cross sectional view of FIG. 17 taken at 19—19.

FIG. 14 shows the inverted position of the pillowcase 30 hanging from the collar end 40 with the plain end 42 down. The fill material 60 is positioned at the plain end as seen from 15—15 in FIG. 14. Once the fill material 60 has been positioned in the plain end 42 of the pillowcase 30, the twin tubular sections 32, 34 (which are now empty) can be folded, as can be seen in FIG. 16, towards the plain end 42 of the pillowcase. The twin tubular end buttons 64, 62 are folded completely over the side of the pillowcase to mate with the button holes 46, 48 at the end of the plain end of the pillowcase 30. A cross sectional view of the assembled configuration is shown in FIG. 19. FIG. 19 is a sectional view of FIG. 17 taken at 19—19. FIG. 17 shows the two tubular collar sections 32, 34 attached to the side of the pillowcase 30. FIG. 18 shows the pillow of FIG. 17 turned over so that the connections between the button 64 and the button hole 48 and button 62 and the button hole 46 in the closed sewn end section 44 can be seen.

The invention includes a method of converting a neck pillow to a plain pillow comprising the steps of releasing a plain end flap of a pillowcase from a side of the pillowcase, causing a fill of the pillowcase to flow from a set of two tubular collar sections to a plain end of a pillowcase, thus leaving the two tubular collar sections substantially empty of fill, and said plain end flap full of fill, and folding the now substantially empty tubular collar sections onto the side of the pillowcase and attaching them to the side of the pillowcase. The step of releasing and later attaching the pillowcase includes removing a first button from a button hole and placing a second button through the same button hole.

The orientation of the buttons, as shown in the figures, is such that one single button hole is used for two buttons having alternate positions. It may be possible to construct a configuration where each button has its own particular button hole, but the present configuration is more efficient and elegantly constructed.

While the invention has been described with regard to the specific embodiments, those skilled in the art will recognize that changes can be made in form and detail without departing from the spirit and scope of the invention.

I claim:

1. A convertible neck pillow comprising:

a pillowcase enclosing a particular volume of a granular fill material;

wherein said pillowcase includes a collar end and plain end;

wherein said pillowcase at said collar end includes two tubular collar sections extending approximately in the same direction with a saddle section sized to receive the neck of a person extending between the two tubular collar sections;

wherein the size of said pillowcase is such that when said granular fill material is positioned to substantially fill said collar end of said pillowcase, said two tubular collar sections of said pillowcase and a middle portion of said pillowcase, including said saddle section, are substantially full of granular material, while granular fill material is substantially absent from said plain end of said pillowcase, such that a plain end flap of said pillowcase can be folded over a side of said pillowcase to capture and hold the granular fill material in said collar end of said pillowcase;

when said granular fill material is positioned to substantially fill said plain end of said pillowcase, said plain end of said pillowcase and said middle portion of said pillowcase, are substantially full of granular material, while granular fill material is substantially absent from said two tubular collar sections at said collar end of said pillowcase, such that said two tubular collar sections of said pillowcase can be folded over a side of said pillowcase to capture and hold the granular fill material in said plain end of said pillowcase.

2. The convertible neck pillow as in claim 1, wherein when said plain end flap of said pillowcase is folded over a side of said pillowcase to capture and hold the granular fill material in said collar end of said pillowcase, an end of said plain end flap can be attached to a side of said pillowcase by first and second connection structures of a fastener system.

3. The convertible neck pillow as in claim 1, wherein when said two tubular collar sections of said pillowcase are folded over a side of said pillowcase to capture and hold the granular fill material in said plain end of said pillowcase, the ends of said two tubular collar sections can be attached to a side of said pillowcase by a second connection structure and a third connection structure of a fastener system.

4. The convertible neck pillow as in claim 1, wherein when said plain end flap of said pillowcase is folded over a side of said pillowcase to capture and hold the granular fill material in said collar end of said pillowcase, an end of said plain end flap can be attached to a side of said pillowcase by first and second connection ends of a fastener system;

wherein when said two tubular collar sections of said pillowcase are folded over a side of said pillowcase to capture and hold the granular fill material in said plain end of said pillowcase, the ends of said two tubular collar sections can be attached to a side of said pillowcase by second and third connection end of said fastener system.

5. The convertible neck pillow as in claim 4, wherein one of the first and the second connection end is the same type as said third connection end of said fastener system structures, so that only two types of connection ends are present.

6. The convertible neck pillow as in claim 5, wherein the fastener system is a button and button hole system.

7. The convertible neck pillow as in claim 5, wherein the fastener system is a hook and loop system.

8. The convertible neck pillow as in claim 1, wherein the fastener system is a projection and projection receiving snap system.

9. The convertible neck pillow as in claim 1, wherein said granular fill material is buckwheat hulls.

10. A convertible neck pillow comprising:

a pillowcase enclosing a particular volume of flowable fill material;

wherein said pillowcase includes a collar end and plain end;

wherein said pillowcase at said collar end includes two tubular collar sections extending approximately in the same direction with a saddle section sized to receive the neck of a person extending between the two tubular collar sections;

wherein the size of said pillowcase is such that in a first configuration when said particular volume of flowable fill material is positioned to substantially fill said collar end of said pillowcase, said two tubular collar sections of said pillowcase and a middle portion of said pillowcase, including said saddle section, are substantially full of flowable material, while flowable fill material is substantially absent from said plain end of said pillowcase, such that a plain end flap of said pillowcase can be folded over a side of said pillowcase to capture and hold the flowable fill material in said collar end of said pillowcase;

in a second configuration when said particular volume of flowable fill material is positioned to substantially fill said plain end of said pillowcase, said plain end of said pillowcase and said middle portion of said pillowcase, are substantially full of flowable material, while flowable fill material is substantially absent from said two tubular collar sections at said collar end of said pillowcase, such that said two tubular collar sections of said pillowcase can be folded over a side of said pillowcase to capture and hold the flowable fill material in said plain end of said pillowcase.

11. The convertible neck pillow as in claim 10, wherein when said plain end flap of said pillowcase is folded over a side of said pillowcase to capture and hold the flowable fill material in said collar end of said pillowcase, an end of said plain end flap can be attached to a side of said pillowcase by first and second connection structures of a fastener system.

12. The convertible neck pillow as in claim 10, wherein when said two tubular collar sections of said pillowcase are folded over a side of said pillowcase to capture and hold the flowable fill material in said plain end of said pillowcase, the ends of said two tubular collar sections can be attached to a side of said pillowcase by a second connection structure and a third connection structure of a fastener system.

13. The convertible neck pillow as in claim 10, wherein when said plain end flap of said pillowcase is folded over a side of said pillowcase to capture and hold the flowable fill material in said collar end of said pillowcase, an end of said plain end flap can be attached to a side of said pillowcase by first and second connection ends of a fastener system;

wherein when said two tubular collar sections of said pillowcase are folded over a side of said pillowcase to capture and hold the flowable fill material in said plain end of said pillowcase, the ends of said two tubular collar sections can be attached to a side of said pillowcase by second and third connection end of said fastener system.

14. The convertible neck pillow as in claim 13, wherein one of the first and the second connection end is the same type as said third connection end of said fastener system structures, so that only two types of connection ends are present.

15. The convertible neck pillow as in claim 14, wherein the fastener system is a button and button hole system.

16. The convertible neck pillow as in claim 14, wherein the fastener system is a hook and loop system.

17. The convertible neck pillow as in claim 10, wherein the fastener system is a projection and projection receiving snap system.

18. The convertible neck pillow as in claim 10, wherein said flowable fill material is buckwheat hulls.

19. A method of converting a neck pillow to a plain pillow comprising the steps of:

releasing a plain end flap of a pillowcase from a side of said pillowcase;

causing a fill of said pillow to flow from a set of two tubular collar sections which extend approximately in the same direction on two sides of a neck saddle portion of said pillowcase in a collar end of said pillowcase to a plain end of said pillowcase, thus leaving the two tubular collar sections substantially empty of fill and said plain end flap full of fill;

folding the now substantially empty two tubular collar sections onto the side of the pillowcase and attaching them to the side of the pillowcase.

20. The method of converting a neck pillow to a plain pillow as in claim 19, wherein the step of releasing and later of attaching includes removing a first button from a button hole and placing a second button through said button hole.

* * * * *